US009618893B2

(12) United States Patent
Noda

(10) Patent No.: US 9,618,893 B2
(45) Date of Patent: Apr. 11, 2017

(54) IMAGE FORMATION DEVICE USING LONG MEDIUM AND CAPABLE OF CORRECTING MISREGISTATION

(71) Applicant: Oki Data Corporation, Tokyo (JP)

(72) Inventor: Yasuo Noda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/798,500

(22) Filed: Jul. 14, 2015

(65) Prior Publication Data

US 2016/0091850 A1 Mar. 31, 2016

(30) Foreign Application Priority Data

Sep. 29, 2014 (JP) ..... 2014-199172

(51) Int. Cl.
*G03G 15/01* (2006.01)
*G03G 15/00* (2006.01)

(52) U.S. Cl.
CPC ..... *G03G 15/5054* (2013.01); *G03G 15/0178* (2013.01); *G03G 2215/0161* (2013.01)

(58) Field of Classification Search
CPC ..... G03G 15/5054; G03G 15/5062; G03G 15/5058; G03G 15/6571; G03G 15/6523
USPC ..... 399/301
See application file for complete search history.

(56) References Cited

U.S. PATENT DOCUMENTS 4,912,491 A * 3/1990 Hoshino ..... G03G 15/0194 347/116
5,973,795 A * 10/1999 Iida ..... G03G 15/5062 399/59
6,327,453 B1 * 12/2001 Imaizumi ..... G03G 15/0194 399/301
6,650,864 B2 * 11/2003 Miyamoto ..... B41J 3/60 399/301
2006/0222419 A1 * 10/2006 Ishibashi ..... H04N 1/00002 399/301
2008/0034996 A1 * 2/2008 Yamamoto ..... G03G 15/652 101/225
2008/0112746 A1 * 5/2008 Yamamoto ..... G03G 15/70 399/385
2008/0145123 A1 * 6/2008 Kogure ..... B41J 11/007 399/395

(Continued)

FOREIGN PATENT DOCUMENTS

JP 2001-134041 A 5/2001

*Primary Examiner* — Billy Lactaoen
*Assistant Examiner* — Arlene Heredia Ocasio
(74) *Attorney, Agent, or Firm* — Mots Law, PLLC

(57) ABSTRACT

An image formation device includes: an image formation unit configured to perform image formation processing of forming a print image based on a print job on a medium using developers of different colors; a misregistration check image formation unit configured to control the image formation unit to cause the image formation unit to form a misregistration check pattern on the medium; a misregistration correction amount input unit configured to receive input of an amount of misregistration correction to be applied to the image formation unit; and a controller configured to correct misregistration in the image formation processing by the image formation unit, based on the amount of misregistration correction received by the misregistration correction amount input unit.

12 Claims, 8 Drawing Sheets

(56) References Cited

U.S. PATENT DOCUMENTS

| | | | | |
|---|---|---|---|---|
| 2008/0253786 | A1* | 10/2008 | Isobe | G03G 15/5004 399/69 |
| 2010/0243697 | A1* | 9/2010 | Aoki | B41J 11/46 226/9 |
| 2011/0150511 | A1* | 6/2011 | Nomura | H04N 1/113 399/51 |
| 2011/0182600 | A1* | 7/2011 | Mizuno | G03G 15/0131 399/39 |
| 2012/0081715 | A1* | 4/2012 | Takano | G06K 15/16 358/1.5 |
| 2013/0016382 | A1* | 1/2013 | Kitajima | G03G 15/0189 358/1.13 |
| 2013/0250314 | A1* | 9/2013 | Kobayashi | G03G 15/5062 358/1.5 |
| 2014/0064747 | A1* | 3/2014 | Numazu | G03G 15/5062 399/19 |
| 2014/0321889 | A1* | 10/2014 | Kosasa | G03G 15/0131 399/301 |

* cited by examiner

CASE OF NO MISREGISTRATION

CASE WHERE COLOR IS MISALIGNED REARWARD WITH RESPECT TO BLACK BY 3 DOTS

CASE OF NO MISREGISTRATION

CASE OF MISREGISTRATION OF MAGENTA

IMAGE FORMATION DEVICE USING LONG MEDIUM AND CAPABLE OF CORRECTING MISREGISTATION

CROSS REFERENCE TO RELATED APPLICATIONS

This application claims priority based on 35 USC 119 from prior Japanese Patent Application No. 2014-199172 filed on Sep. 29, 2014, entitled "IMAGE FORMATION DEVICE AND METHOD OF CONTROLLING IMAGE FORMATION DEVICE", the entire contents of which are incorporated herein by reference.

BACKGROUND OF THE INVENTION

1. Field of the Invention

The disclosure relates to an image formation device and a method of controlling the image formation device, and is applicable to a color printer that performs print processing using a long medium such as a continuous sheet in the form of a large-diameter roll (hereinafter referred to as a "large-diameter roll sheet"), for example.

2. Description of Related Art

In conventional electrophotographic color printers, image formation units including LED heads, photoconductive drums, and transfer rollers have a tandem configuration in which the units of four colors, i.e., black (K), yellow (Y), magenta (M), and cyan (C) are arranged in tandem, and implement a full-color image formation by laying developer images of the respective colors sequentially one over another. Here, the developer images of the respective colors need to be transferred to the same position on a recording medium. If the transfer positions of these colors differ from one another, this entails a problem in that a color tone deviation or misregistration occurs and thus favorable print quality cannot be obtained. In conventional color printers, the main causes for defects such as a color tone deviation and misregistration are errors in the photoconductive drums and the LED heads which are replaceable parts; i.e., misalignment of the parts from their proper mounting positions, the machining accuracy of these parts, and displacement of these parts during the driving. In the conventional color printers, such errors occur while varying over time as the printer repeats printing.

For example, there is a conventional technique described in Japanese Patent Application Publication No. 2001-134041 (Patent Literature 1) to correct misregistration caused by these varying errors in the above color printers that transfer developer images of different colors one over another.

The technique described in Patent Literature 1 employs a misregistration detection pattern recognition method in which: after a sheet is delivered to the outside, a misregistration detection pattern using a black (K) developer image is transferred onto a transport belt as a base pattern; a misregistration detection pattern using a developer image of any of the colors other than black, such as colors of yellow (Y), magenta (M), and cyan (C), is transferred onto the black misregistration detection pattern while being shifted from the black pattern by predefined pitches; and the amount of misregistration is detected by using a difference in reflectance between the black image and the color image.

SUMMARY OF THE INVENTION

Some of the conventional electrophotographic color printers have a configuration in which once an operation for a print job is over, a large-diameter roll sheet (recording medium) is cut by a cutter unit disposed on an upstream side of a transport route and then is delivered to the outside of an image formation device (in what is termed as a roll-to-cut configuration). A conventional color printer having the roll-to-cut configuration is capable of driving the transport belt during standby for the next image formation processing in order to form a misregistration detection pattern on the transport belt and to detect the position of the pattern. However, if the printer performs a post-printing processing, such as laminate coating and label cutting (so-called die cutting) of a self-adhesive label sheet, these print processing and post-printing processing need to be processed as a continuous operation in a predefined direction in what is termed as a roll-to-roll fashion (hereinafter referred to as a "one-pass operation"). Hence, a conventional color printer having the roll-to-roll configuration is incapable of driving a transport belt during standby because a recording medium is kept loaded in the printer all the time. Such a conventional color printer cannot correct mechanical errors occurring over time at an appropriate timing if the printer is in an operation mode where the driving of the transport belt during standby is not possible. For this reason, favorable print quality cannot be obtained in some cases due to the occurrence of a color tone deviation or misregistration.

An embodiment of the invention aims to correct misregistration efficiently when an image is formed on a long medium.

A first aspect of the invention is an image formation device including: an image formation unit configured to perform the image formation processing of forming a print image based on a print job on a long medium using developers of different colors; a misregistration check image formation unit configured to control the image formation unit to cause the image formation unit to form a misregistration check pattern on the medium; a misregistration correction amount input unit configured to receive input of an amount of misregistration correction to be applied to the image formation unit; and a controller configured to correct misregistration in the image formation processing by the image formation unit, based on the amount of misregistration correction received by the misregistration correction amount input unit.

A second aspect of the invention is an image formation method executed by an image formation device including an image formation unit configured to perform the image formation processing of forming a print image based on a print job on a medium using developers of different colors. The method includes: controlling the image formation unit to cause the image formation unit to form, on the medium, a misregistration check pattern indicating a state of misregistration; receiving the user's input of an amount of misregistration correction to be applied to the image formation unit; and correcting misregistration in the image formation processing by the image formation unit based on the amount of misregistration correction thus received.

A third aspect of the invention is an image formation method including: causing an image formation unit to form a print image on a medium based on a print job; determining if a current mode is a roll-to-roll mode; and forming a misregistration detection pattern on the medium if it is determined that the current mode is the roll-to-roll mode, and forming a misregistration detection pattern on a transport belt configured to transport the medium if it is determined that the current mode is not the roll-to-roll mode.

A fourth aspect of the invention is an image formation method including: starting the transport of a medium after receiving a print job; causing an image formation unit to form a print image based on the print job on the medium being transported; causing the image formation unit to form a misregistration check pattern on the medium being transported without stopping the transport of the medium after completion of the forming of the print image based on the print job; and stopping the transport of the medium if it is determined that a temperature of a certain location of the image formation unit is equal to or lower than a predefined threshold temperature after the forming of the misregistration check pattern is over.

According to an aspect of the invention, it is possible to provide an image formation device and a method of controlling the image formation device capable of correcting misregistration efficiently when an image is formed on a long medium.

DETAILED DESCRIPTION OF EMBODIMENTS

Figure 1:
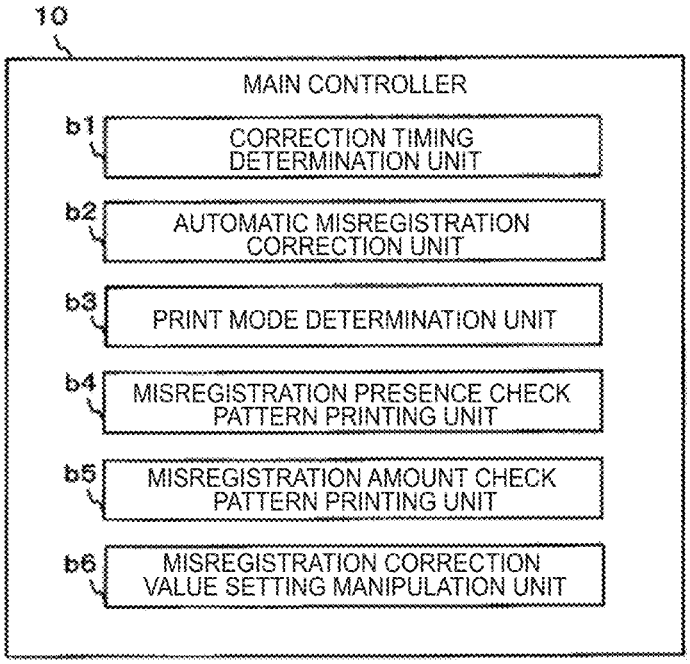
FIG. 1 is a block diagram illustrating a functional configuration of a main controller constituting an image formation device according to an embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

(A) Main Embodiment

An embodiment of an image formation device and an image formation method according to the invention is described below with reference to the drawings.

(A-1) Configuration of Embodiment

Figure 2:
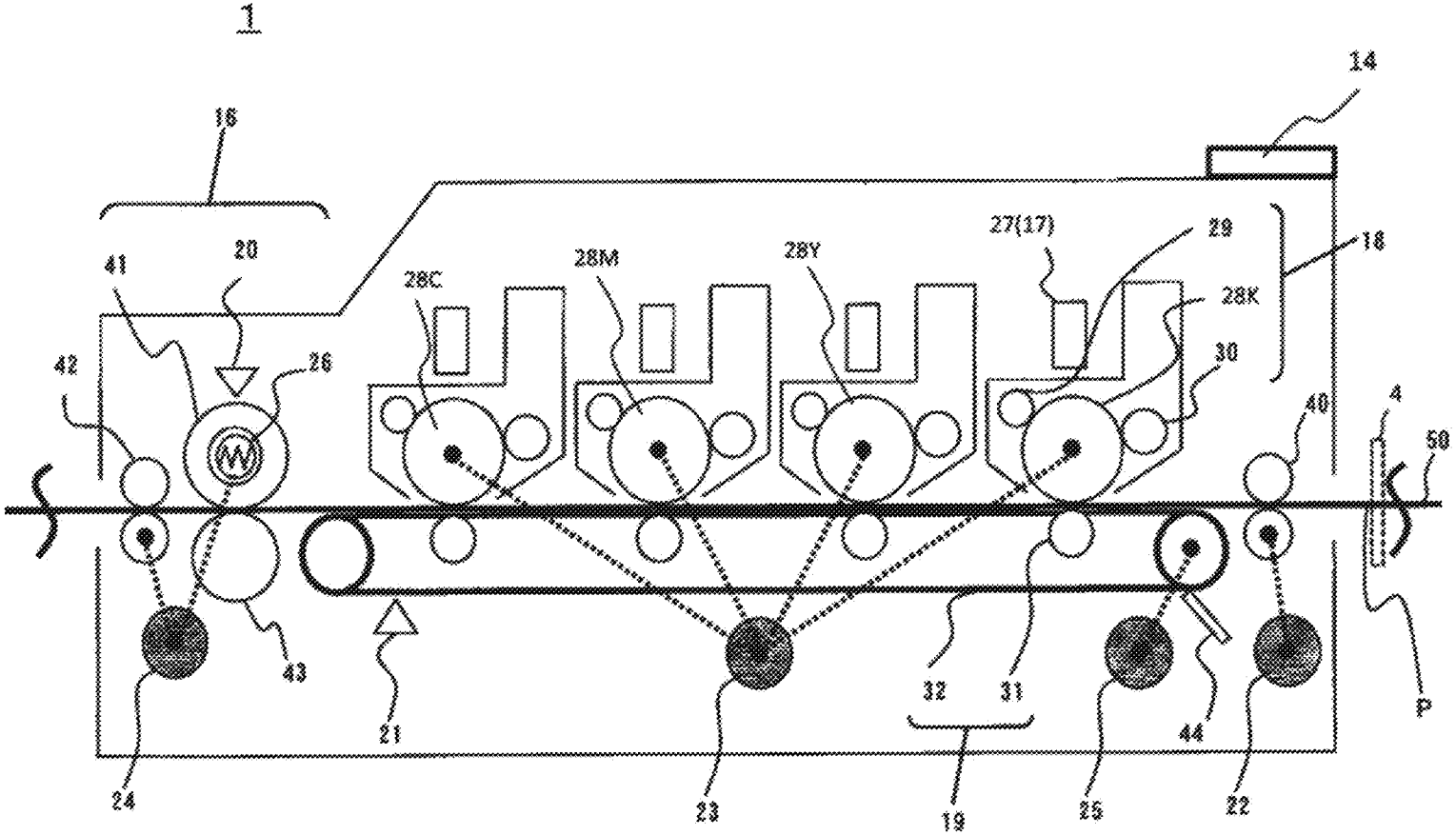
FIG. 2 is a schematic sectional view of the image formation device according to the embodiment.
Figure 3:
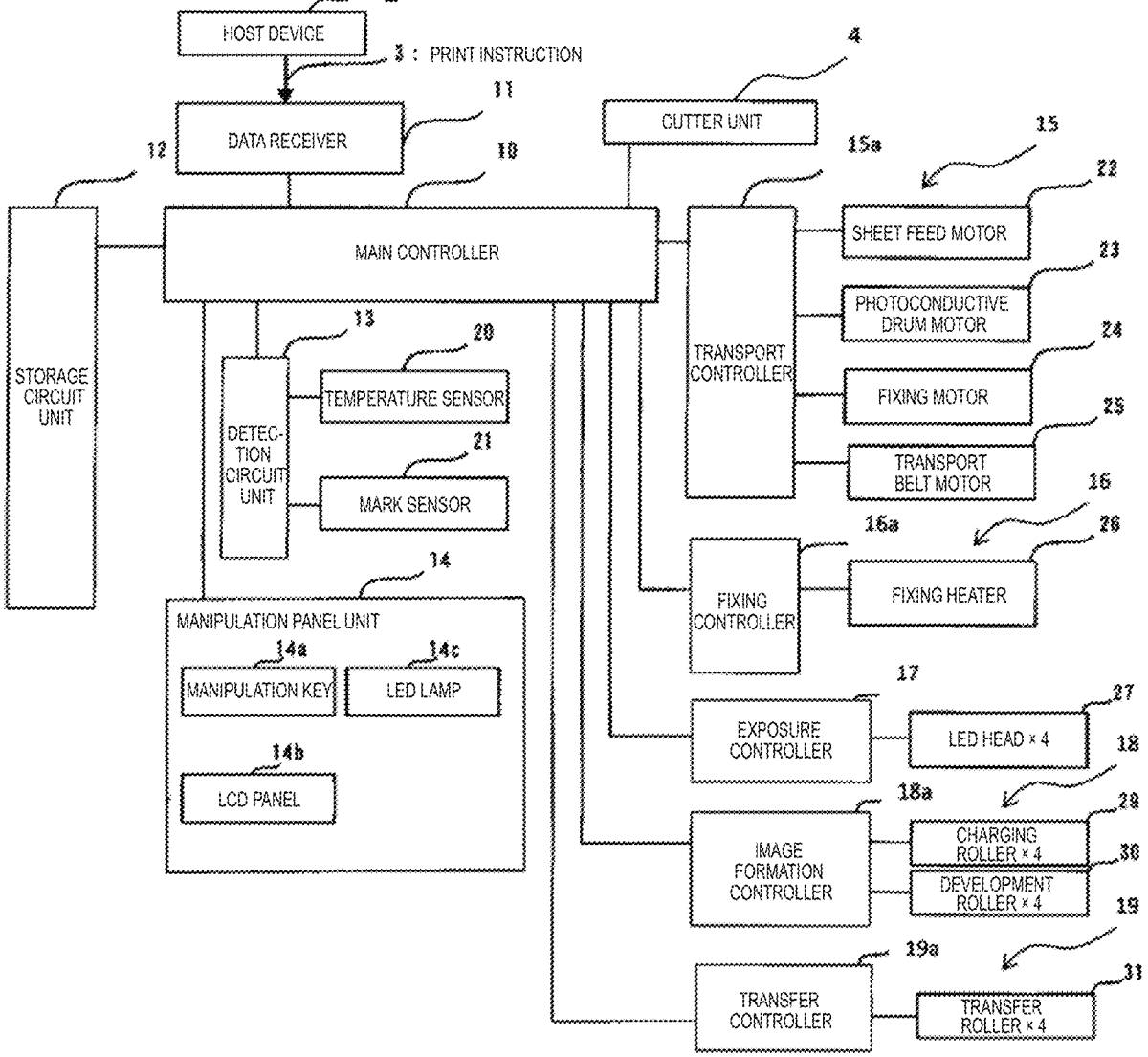
FIG. 3 is a block diagram illustrating a configuration of a control system of the image formation device according to the embodiment.

FIG. 2 is a schematic sectional view of image formation device 1 according to the embodiment. FIG. 3 is a block diagram illustrating a configuration (functional configuration) of a control system of the image formation device according to the embodiment.

Image formation device 1 is a full-color electrophotographic printer to perform print processing on long recording medium P using a large-diameter roll sheet, for example. Image formation device 1 is configured to print (form), on recording medium P, toner images of toner colors of black (K), yellow (Y), magenta (M), and cyan (C).

In image formation device 1, transport route 50 as a transport section is provided to traverse a central part (a central part in a vertical direction in FIG. 2) of the device horizontally. Transport route 50 is configured to transport recording medium P from an upstream side in a medium transport direction (right side in FIG. 2) to a downstream side in the medium transport direction (left side in FIG. 2).

A pair of sheet feed rollers 40 and a pair of sheet delivery rollers 42 are disposed in transport route 50. The pair of sheet feed rollers 40 is configured to transport recording medium P placed on the upstream side in the medium transport direction to the downstream side in the medium transport direction. Pair of sheet delivery rollers 42 is disposed on the downstream side in the medium transport direction and configured to deliver recording medium P to the outside. Note that, in the following description, the width direction of recording medium P is also referred to as a main-scanning direction and the transport direction of recording medium P is also referred to as a sub-scanning direction. In addition, cutter unit 4 configured to cut recording medium P in the main-scanning direction (width direction) is disposed upstream of these rollers on transport route 50. Cutter unit 4 may be a part of the constituents of image formation device 1 or may be an external unit, as long as image formation device 1 can control (give a cutting instruction to) this unit.

Image formation unit 18 and transfer unit 19 are disposed between the pair of sheet feed rollers 40 and the pair of sheet delivery rollers 42 on transport route 50. In other words, in image formation device 1, the pair of sheet feed rollers 40, the image formation unit 18 (transfer unit 19), the fixing unit 16, and the pair of sheet delivery rollers 42 are arranged in this order from the upstream side of transport route 50.

Image formation unit 18 includes photoconductive drums 28 (28K, 28Y, 28M, and 28C) on the surfaces of which toner images (developer images) of the toner colors are to be formed respectively. In addition, charging roller 29, development roller 30, and LED head 27 are arranged for each photoconductive drum 28. Charging roller 29 is in contact with photoconductive drum 28, image exposure unit 17 is placed above photoconductive drum 28, and development roller 30 is in contact with photoconductive drum 28 with a certain pressure. Charging roller 29 is configured to charge a surface of photoconductive drum 28. LED head 27 is configured to expose charged photoconductive drum 28 to light to form an electrostatic latent image. Development roller 30 is configured to allow developer in the form of a thin layer to electrostatically adhere to the formed electrostatic latent image to form a developer image. As described above, image formation unit 18 is a constituent of image formation device 1 configured to form (develop) toner images on the surfaces of photoconductive drums 28 for the toner colors, respectively.

Using image formation unit 18, image formation device 1 is operable in either a roll-to-cut print mode (first image formation mode) or a roll-to-roll print mode (second image formation mode). The roll-to-cut print mode is a mode where recording medium P subjected to a given print processing (on which a given print job has been executed) is cut by cutter unit 4. The roll-to-roll print mode is a mode where recording medium P subjected to a given print processing is not cut by cutter unit 4.

Transfer unit 19 includes transport belt 32 and transfer rollers 31 arranged at positions opposed to respective photoconductive drums 28. In other words, transfer roller 31 is disposed at a position opposed to each photoconductive drum 28 with transport belt 32 interposed therebetween. Each photoconductive drum 28 transports recording medium P downstream while pinching recording medium P and transport belt 32 between itself and opposed transfer roller 31. As described above, photoconductive drums 28, transfer rollers 31, and transport belt 32 constitute a part of transport route 50. Transfer unit 19 is configured to transfer, onto recording medium P passing through transfer unit 19, toner images developed on the surfaces of respective photoconductive drums 28.

Mark sensor 21 and cleaning blade 44 are disposed below transport belt 32. Mark sensor 21 is configured to detect an image formed on transport belt 32. Cleaning blade 44 is configured to scrape off and clean toner (including toner of a misregistration detection pattern to be described later) adhering to transport belt 32. Mark sensor 21 is a sensor to optically detect an image on transport belt 32. A reflective optical sensor constituted by a light-emitting element and a light-receiving element may be used as mark sensor 21, for example.

The pair of sheet feed rollers 40 is driven by sheet feed motor 22 placed below the pair of sheet feed rollers 40.

The pair of sheet delivery rollers 42 is driven by fixing motor 24 placed below and rightward of the pair of sheet delivery rollers 42.

Photoconductive drums 28 are driven by photoconductive drum motor 23 placed below photoconductive drums 28.

Transport belt 32 is driven by transport belt motor 25 placed below transport belt 32.

Fixing unit 16 is placed downstream of image formation unit 18 and transfer unit 19 and is configured to fix, with application of heat and pressure, toner images on recording medium P transferred by transfer unit 19. Fixing unit 16 includes fixing roller 41 being cylindrical to transport recording medium P while heating recording medium P, and pressure roller 43 in pressure contact with fixing roller 41 and configured to pressurize recording medium P. Fixing unit 16 further includes temperature sensor 20 as a temperature detection section placed above fixing roller 41 and configured to detect the surface temperature of fixing roller 41. Fixing roller 41 includes fixing heater 26 placed inside a cylindrical cored bar of fixing roller 41 and configured to heat recording medium P. Fixing roller 41 is driven by fixing motor 24 in conjunction with the pair of sheet delivery rollers 42. A thermistor may be used as temperature sensor 20, for example.

A configuration of a control system of image formation device 1 is described using FIG. 3.

As illustrated in FIGS. 2 and 3, image formation device 1 further includes main controller 10 as a controller, data receiver 11, storage circuit unit 12, detection circuit unit 13, and manipulation panel unit 14 constituting a correction amount input section.

Data receiver 11 is configured to receive, from host device 2 or from an external device, print instruction 3 including control data, print data, control signals, and the like. Data receiver 11 is also configured to give received print instruction 3 to main controller 10.

Main controller 10 functions as a controller configured to analyze print instruction 3 received from host device 2 and perform programmatic control over the entire image formation device. Main controller 10 may be constituted by a central processing unit (CPU), for example.

Storage circuit unit 12, manipulation panel unit 14, detection circuit unit 13, and transport controller 15*a* are connected to main controller 10. Also, main controller 10, fixing controller 16*a* configured to control and drive fixing unit 16, exposure controller 17*a* configured to control and drive LED heads 27 (four LED heads 27 in total), image formation controller 18*a* configured to control and drive image formation unit 18, and transfer controller 19*a* configured to control and drive transfer unit 19 are all connected.

Storage circuit unit 12 is a storage section configured to store various kinds of setting information of image formation device 1. For example, storage circuit unit 12 includes a nonvolatile memory configured to store various kinds of setting information, and a buffer memory used to expand print data, received from host device 2, in a temporary storage area (hereinafter referred to as a raster image buffer) configured to temporarily store the print data for printing.

In storage circuit unit 12, at least the amount of correction for correcting misregistration of each toner color (misregistration correction amount) is registered. Main controller 10 executes the processing (such as print processing and misregistration correction processing) based on the set values of storage circuit unit 12.

Manipulation panel unit 14 functions as a user interface of image formation device 1. In this embodiment, manipulation panel unit 14 is capable of receiving (through manipulation of various menus, for example) settings such as information on the operation mode of image formation device 1 at the time of the print processing. In this embodiment, manipulation panel unit 14 includes manipulation key 14*a*, liquid crystal display (LCD) panel 14*b* used to display a manipulation status, and LED lamp 14*c* used to represent a power on/off state and the like. Note that the information input/output configuration of manipulation panel unit 14 is not limited to the above example, and various configurations (a touch panel display, for example) may be used instead.

Detection circuit unit 13 is a circuit to process detection results from temperature sensor 20 and mark sensor 21 described above, and to send the processing result to main controller 10.

Transport controller 15*a* is configured to drive sheet feed motor 22, photoconductive drum motor 23, fixing motor 24, and transport belt motor 25 described above, for example.

Fixing controller 16*a* is configured to drive fixing heater 26 described above, for example.

Image formation controller 18*a* is configured to apply voltages on charging roller 29 and development roller 30 described above, for example.

Transfer controller 19*a* is configured to apply voltages on transfer rollers 31 described above, for example.

Next, a functional configuration of main controller 10 (functional configuration of firmware) is described using FIG. 1.

Main controller 10 changes the contents of the misregistration correction processing to be employed between the processing to be performed after printing in the roll-to-cut print mode and the processing to be performed after printing in the roll-to-roll print mode. After the printing in the roll-to-cut print mode, main controller 10 controls cutter unit 4 to make cutter unit 4 cut recording medium P and to deliver cut recording media P to the outside of image formation device 1. Hence, main controller 10 can drive transport belt 32 during standby of the image formation device after the printing in the roll-to-cut print mode. This makes it possible to obtain the amount of misregistration (misregistration amount) and perform misregistration correction processing by printing a pattern for misregistration correction (hereinafter referred to as a misregistration correction pattern) on transport belt 32 and making mark sensor 21 detect the misregistration amount.

On the other hand, after the printing in the roll-to-roll print mode, image formation device 1 does not cut recording medium P or deliver cut recording media P to the outside. Hence, main controller 10 cannot drive transport belt 32 even after the print processing. To address this, after the printing in the roll-to-roll print mode, main controller 10 of this embodiment controls image formation unit 18 and the like to make image formation unit 18 and the like print a pattern that allows the user to visually check a state of misregistration (such a pattern is hereinafter referred to as a "misregistration check pattern") on recording medium P. Then, in response to an input of a misregistration correction amount (misregistration amount) by the user (the user having visually checked the misregistration check pattern), main controller 10 performs misregistration correction based on the misregistration correction amount thus inputted.

Note that, in this embodiment, immediately after the printing in the roll-to-roll print mode, main controller 10 prints a pattern that allows the user to visually check if there is misregistration (such a pattern is hereinafter referred to as a "misregistration presence check pattern") as a misregistration check pattern. Further in this embodiment, according to the manipulation by the user, main controller 10 also prints a pattern that allows the user to visually check the misregistration amount currently occurring.

In the following description, the misregistration correction processing performed by printing a misregistration correction pattern on transport belt 32 and making mark sensor detect the misregistration amount is referred to as "automatic misregistration correction processing," and misregistration correction processing performed by printing a misregistration check pattern on recording medium P and receiving a manual input of the misregistration correction amount by the user is referred to as "manual misregistration correction processing."

In addition, main controller 10 determines to perform the next misregistration correction processing (automatic misregistration correction processing or manual misregistration correction processing) at a time point where the amount of operation (printing) of image formation unit 18 reaches a predefined amount since the last misregistration correction processing (automatic misregistration correction processing or manual misregistration correction processing). In the following description, the timing at which main controller 10 determines to execute the next misregistration correction processing is referred to as "correction timing." The way of measuring the amount of operation described above is not particularly limited. In this embodiment, main controller 10 measures a transport distance of recording medium P (the number of revolutions of transport belt motor 25 during printing, for example) as the amount of operation. In other words, main controller 10 of this embodiment detects, as the correction timing, the timing at which the transport distance of recording medium P reaches a predefined distance since the last misregistration correction processing. As to the transport distance deciding the correction timing, its error varies over time depending on, for example, the accuracy in the mounting of the mechanical constituents in image formation device 1 or the temperature expansion of the mechanical constituents associated with environmental temperature changes during printing. For this reason, an optimal distance is obtained and set through experiments for example.

As constituents to carry out the misregistration correction processing described above, main controller 10 includes a correction timing determination unit b1, an automatic misregistration correction unit b2, a print mode determination unit b3, a misregistration presence check pattern printing unit b4, a misregistration amount check pattern printing unit b5, and a misregistration correction value setting manipulation unit b6 as a misregistration correction amount input unit. Note that the internal configuration of main controller 10 is not limited to the configuration example of FIG. 1 as long as an alternative configuration example enables execution of the misregistration correction processing described above.

Correction timing determination unit b1 is configured to perform a processing that measures the amount of operation (printing) and determines whether or not the amount of operation thus measured exceeds that of the correction timing for executing misregistration correction.

Automatic misregistration correction unit b2 is configured to perform a control on the processing of transferring a misregistration correction pattern onto transport belt 32, reading the misregistration amount with mark sensor 21, and correcting the misregistration amount (automatic misregistration correction processing).

Print mode determination unit b3 is configured to perform a processing of the determining of whether the print mode instructed by host device 2 (the print mode of the latest print job) is the roll-to-roll print mode or the roll-to-cut print mode.

Misregistration presence check pattern printing unit b4 is configured to perform a control processing of the printing of a misregistration presence check pattern on recording medium P.

Misregistration amount check pattern printing unit b5 is configured to perform a control processing of the printing of a misregistration amount check pattern on recording medium P.

Misregistration correction value setting manipulation unit b6 is configured to perform a processing of the receiving of a misregistration correction value inputted by the user using manipulation panel unit 14.

(A-2) Operation of Embodiment

Next, an operation of image formation device 1 of this embodiment having the above configuration (a method of controlling the image formation device according to this embodiment) is described.

Figure 4:
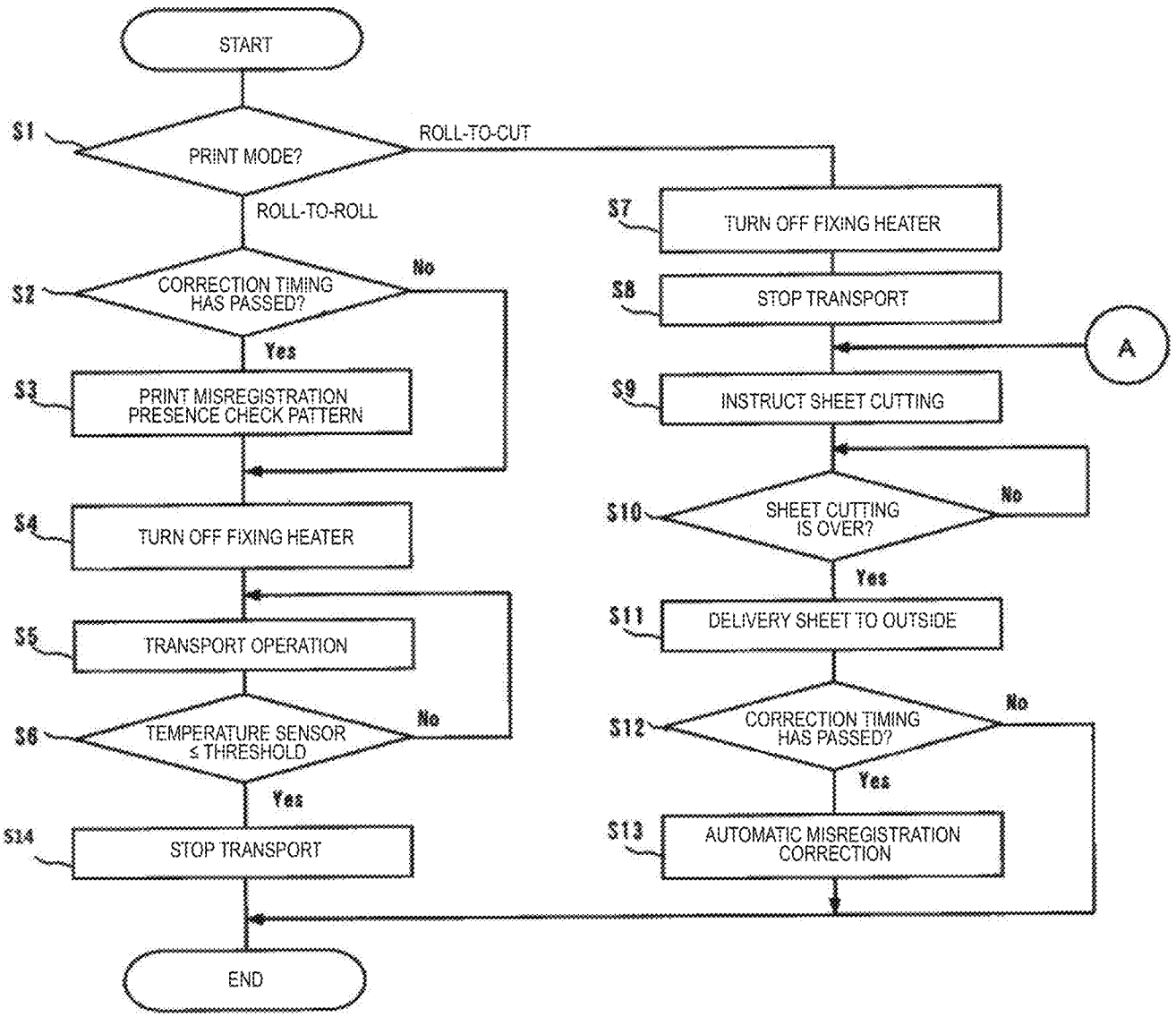
FIG. 4 is a flowchart (No. 1) illustrating an operation of the image formation device according to the embodiment.
Figure 5:
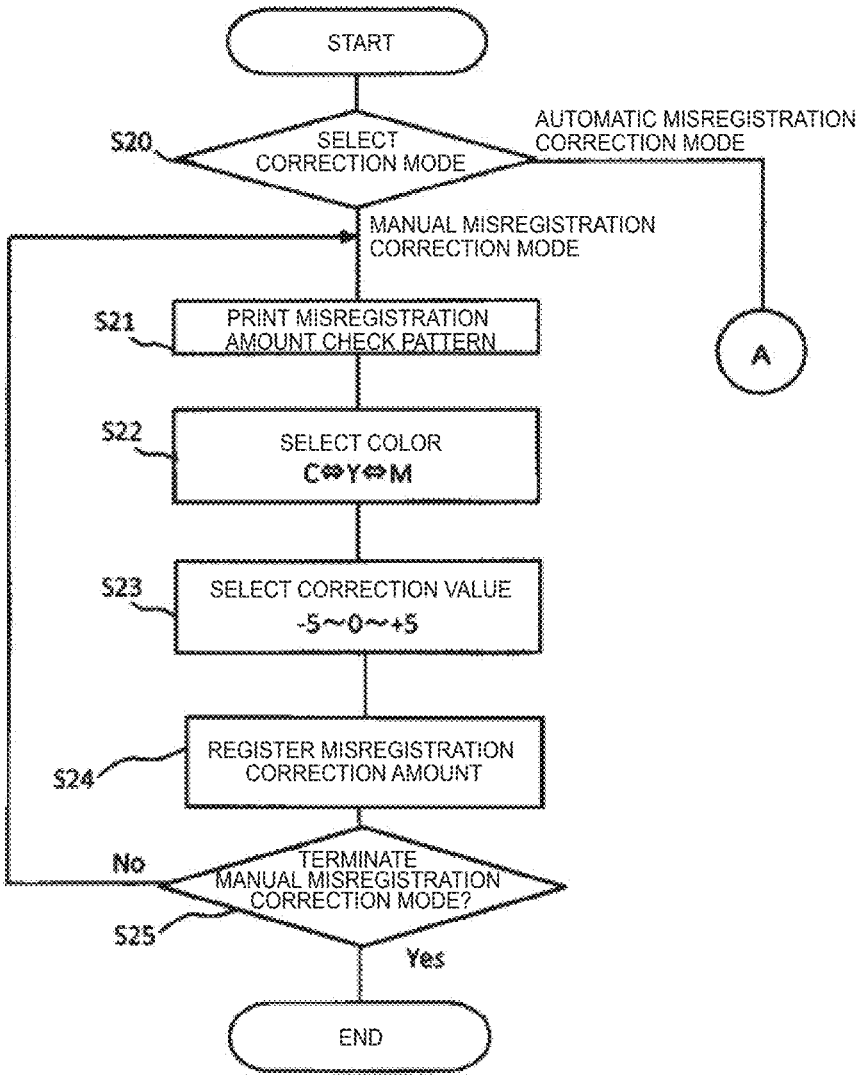
FIG. 5 is a flowchart (No. 2) illustrating the operation of the image formation device according to the embodiment.

FIGS. 4 and 5 are flowcharts illustrating the processing to be performed by image formation device 1 (main controller 10).

The flowcharts of FIGS. 4 and 5 illustrate the processing performed after a print job passes through fixing unit 16 and printing is done according to print instruction 3 made by host device 2 or when no further print job instruction is given by host device 2 and therefore printing needs to be terminated, based on the assumption that recording medium in the form of a large-diameter roll is loaded in image formation device 1. In other words, the flowcharts in FIGS. 4 and 5 illustrate the processing performed after certain print processing is done in image formation device 1.

After printing is done (or after printing is terminated), main controller 10 determines the print mode of the latest print job (Step S1). Main controller 10 starts its operation from Step S2 (described later) if the print mode thus determined is the roll-to-roll print mode, and from Step S7 (described later) if the print mode thus determined is the roll-to-cut print mode.

If the print mode is the roll-to-cut print mode, main controller 10 performs control to turn off fixing heater 26 (Step S7). The temperature of the heat accumulated in fixing roller 41 is thereafter decreased by heat dissipation or heat absorption into recording medium P.

Next, main controller 10 makes transport unit 15 stop the transport operation (Step S8).

Next, main controller 10 instructs cutter unit 4 disposed on the upstream side of transport route 50 to cut recording medium P (sheet) (Step S9).

Next, main controller 10 checks whether the cutting by cutter unit 4 is over (Step S10). If the cutting is over, main controller 10 performs control processing (transport control processing) of delivering cut recording media P to the outside of image formation device 1 (Step S11).

Next, main controller 10 determines whether or not the correction timing has passed (whether or not the amount of operation since the last misregistration correction processing has reached the predefined amount or more) (Step S12). The processing moves to Step S13 to be described later if the correction timing has passed, and the processing is terminated if the correction timing has not passed.

If the correction timing has arrived, main controller 10 executes automatic misregistration correction processing (Step S13) and terminates the processing. A detailed example of the automatic misregistration correction processing is to be described later.

On the other hand, if it is confirmed that the print mode is the roll-to-roll print mode in Step S1 above, main controller 10 checks whether or not the correction timing has passed (whether or not the amount of operation since the last misregistration correction processing has reached the predefined amount or more). Main controller 10 controls its constituents to make its constituents print a misregistration presence check pattern during cool-down of the printer only if it is confirmed that the correction timing has passed (Steps 2 and 3). The misregistration presence check pattern is to be described in detail later.

Next, main controller 10 turns off fixing heater 26 (Step S4). The temperature of the heat accumulated in fixing roller is thereafter decreased by heat dissipation or heat absorption into recording medium P. However, because image formation device in the roll-to-roll print mode makes fixing roller 41 keep closely in contact with recording medium. P even during standby, the heat of fixing roller 41 can deform, discolor, or scorch recording medium P. Hence, it is preferable to stop transport after the temperature of fixing roller 41 is decreased enough.

For this reason, main controller 10 keeps transporting recording medium P until the surface temperature of fixing roller 41 detected by temperature sensor 20 becomes a threshold temperature or lower, and then stops the transport of recording medium P (Steps S5 to S7) to terminate the processing. To put it another way, the control processing from Steps S5 to S7 needs to be performed after image formation device 1 carries out the print processing in the roll-to-roll print mode regardless of whether or not misregistration correction processing is to be performed. Thus, it means that there is no increase in the amount of consumed recording medium P even if a misregistration presence check pattern is printed immediately after the printing based on the print job.

Then, the user visually observes the misregistration check pattern to check whether or not there is misregistration. In this embodiment, it is assumed that main controller 10 has started receiving the manipulation for misregistration correction in response to the manipulation on manipulation panel unit 14 by the user. For example, main controller 10 may start receiving manipulation for misregistration correction upon receiving certain menu manipulation at manipulation panel unit 14.

Once main controller 10 starts receiving manipulation for misregistration correction, it uses manipulation panel unit 14 to perform processing of letting the user select any one of an automatic misregistration correction mode for carrying out misregistration correction automatically and a manual misregistration correction mode for carrying out misregistration correction manually (S20). For example, main controller 10 may display a manipulation screen for selection between the automatic misregistration correction mode and the manual misregistration correction mode on LCD panel 14*b* of manipulation panel unit 14 and let the user select any one of these modes by pressing manipulation key 14*a*. Main controller 10 operates from Step S21 to be described later if the manual misregistration correction mode is selected, and operates from Step S9 described above to execute the processing of the automatic misregistration correction mode (automatic misregistration correction processing) if the automatic misregistration correction mode is selected. Note that, however, image formation device 1 needs to be operated in the roll-to-cut print mode in order to execute the processing of the automatic misregistration correction mode (automatic misregistration correction processing) because transport belt 32 needs to be driven (caused to run idle) for this processing. In this event, main controller 10 may instruct cutter unit 4 to cut recording medium P to execute the processing of the automatic misregistration correction mode (automatic misregistration correction processing) forcibly even when image formation device 1 is operating in the roll-to-roll print mode. Alternatively, main controller 10 may stop the operation (to execute error processing by prompting the user to select the roll-to-cut print mode, for example).

If the manual misregistration correction mode is selected in Step S20 described above, main controller 10 controls its constituents to make its constituents print, on recording medium P, a misregistration amount check pattern which enables the user to visually check the misregistration amount (S21).

Next, main controller 10 controls manipulation panel unit 14 to let the user input (select) a toner color (color) that requires automatic misregistration correction processing and the amount of misregistration correction (misregistration correction amount) for the selected toner color (Steps S22 and S23). For example, main controller 10 may display a manipulation screen for selection of the toner color (any one of the colors of cyan, magenta, and yellow) and selection of the misregistration correction amount (any one of integers from −5 to +5) and let the user select by pressing manipulation key 14*a*.

Next, main controller 10 performs the processing of registering the toner color and the misregistration correction amount thus inputted (processing of data writing to storage circuit unit 12). Main controller 10 thereby controls image formation unit 18 to make image formation unit 18 execute print processing in consideration of the misregistration correction amount inputted this time (print processing in consideration of the misregistration correction amount inputted for the selected toner color).

Next, main controller 10 controls manipulation panel unit 14 to let the user select whether to terminate or continue the misregistration correction processing (Step S25). Main controller 10 terminates the misregistration correction processing if the termination of the processing is selected, and returns to Step S21 described above if the continuance of the processing is selected.

Note that main controller 10 may receive only misregistration check pattern print processing through manipulation of a certain menu. This enables the user to check the misregistration amount after the change in the misregistration correction amount.

Next, a description is given of an example of the automatic misregistration correction processing performed in Step S13 described above.

Figure 6A:
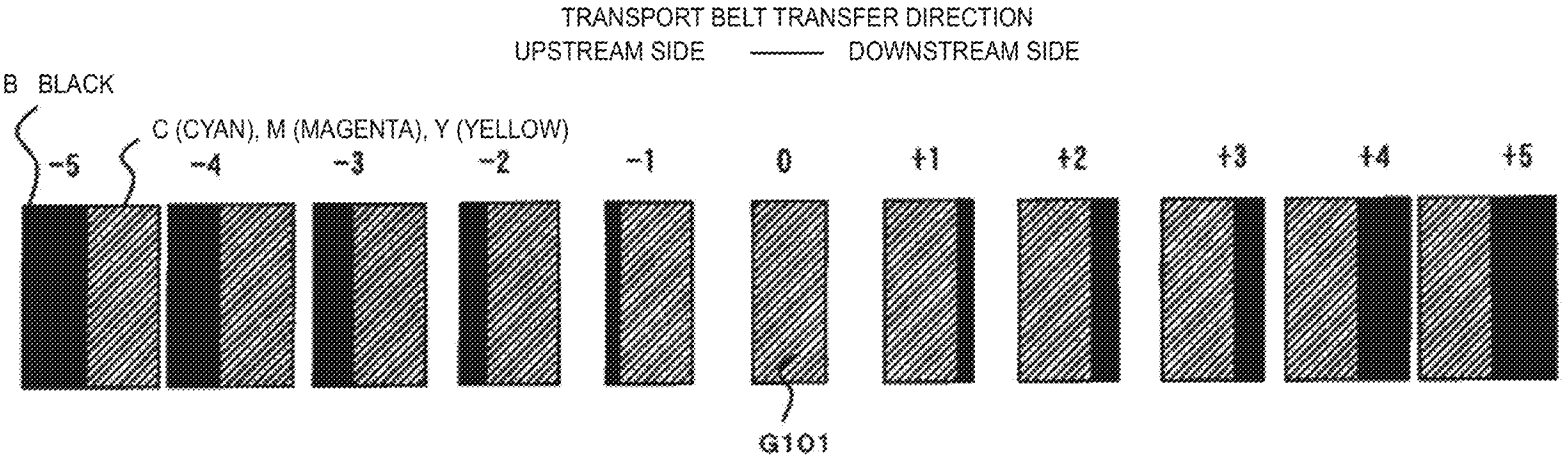
FIGS. 6A and 6B are explanation diagrams illustrating a configuration example of a misregistration detection pattern printed by the image formation device according to the embodiment.
Figure 6B:
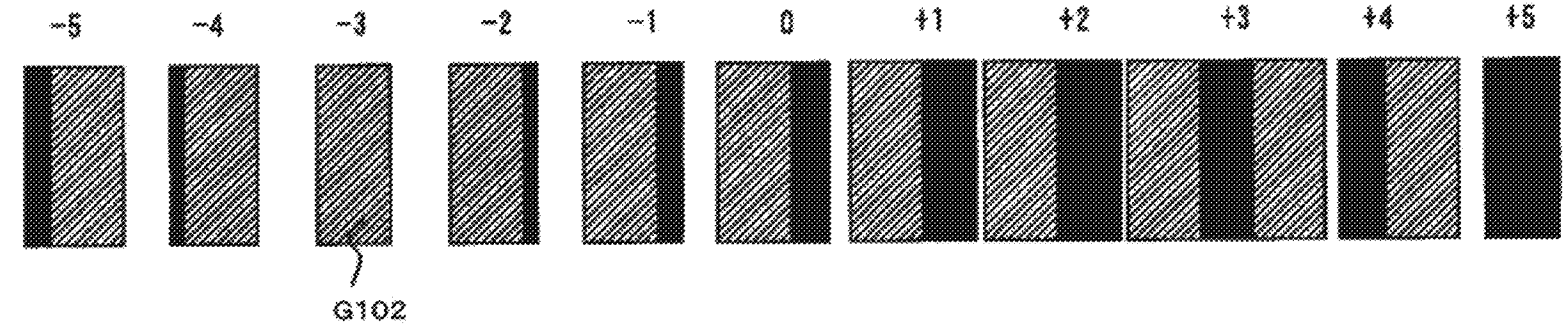

FIGS. 6A and 6B are explanation diagrams illustrating an example of a misregistration detection pattern transferred (printed) onto transport belt 32 at the time of the automatic misregistration correction processing in Step S13 described above.

In the automatic misregistration correction processing, main controller 10 transfers a misregistration detection pattern onto transport belt 32 and makes mark sensor 21 read the misregistration detection pattern thus transferred. Then, main controller 10 performs the misregistration correction processing based on a result of the reading by mark sensor 21.

The misregistration detection pattern in each of FIGS. 6A and 6B is an image for detecting the amount of misregistration of an image of a color other than black (any of cyan, magenta, and yellow) (also called a color image) with respect to an image of black as a reference image. In the misregistration detection pattern illustrated in each of FIGS. 6A and 6B, there are images (hereinafter referred to as "block images for detection") each made by transferring, onto a rectangular black image, an image of a color other than black (image having the same shape as the black image) in such a way that the color image may not be displaced, or may be displaced by a predefined amount (misregistration amount corrected on the print data) from the black image. In the following description, in the misregistration detection pattern, a downstream side in a belt transfer direction (direction in which the misregistration detection pattern is transferred onto transport belt 32) is referred to as a plus direction (+ direction) and an upstream side in the belt transfer direction is referred to as a minus direction (− direction).

The misregistration detection pattern in each of FIGS. 6A and 6B illustrates a state of transfer of 11 block images for detection in which the color images are displaced from the corresponding black images by values in a range from −5 dots to +5 dots sequentially.

FIG. 6A illustrates a transfer example of the misregistration detection pattern in the case of no misregistration amount in the transfer (misregistration amount of 0). The pattern in FIG. 6A can be acknowledged as having no misregistration amount since the black image and the color image perfectly overlap each other in block image for detection G101 with a correction amount of 0.

FIG. 6B illustrates a transfer example of the misregistration detection pattern in the case where the misregistration amount (the amount of misregistration of the color image with respect to the black image) is −3 dots (3 dots on the upstream side in the sub-scanning direction). In FIG. 6B, the black image and the color image perfectly overlap each other in block image for detection G102 with a correction amount of −3 dots.

As described above, in the automatic misregistration correction processing, main controller 10 transfers a misregistration detection pattern onto transport belt 32, detects a block image for detection in which a pattern of black and a pattern of a color other than black overlap best, and identifies the misregistration correction amount of the block image for detection thus detected. For each of the colors other than black (cyan, magenta, and yellow), main controller 10 identifies a correction amount for correcting a misregistration of the color with respect to black as the reference color. In other words, main controller 10 prints a misregistration detection pattern for each of the colors other than black (cyan, magenta, and yellow) and identifies the misregistration correction amount.

Then, main controller 10 applies the identified misregistration correction amount to image formation unit 18 (i.e., performs correction such that the exposure timing for a target color may be ahead of or behind the exposure timing for black by the identified correction amount). For example, in the case where a result of the printing of the misregistration detection pattern is as illustrated in FIG. 6B, main controller performs the automatic misregistration correction processing by controlling image formation unit 18 so that the exposure timing for the target color may become ahead of the exposure timing for black by 3 dots.

Note that, in this embodiment, various methods may be employed to implement a concrete configuration for identifying the misregistration amount of each toner color and performing a correction based on the identified misregistration amount in the automatic misregistration correction processing.

Figure 7A:
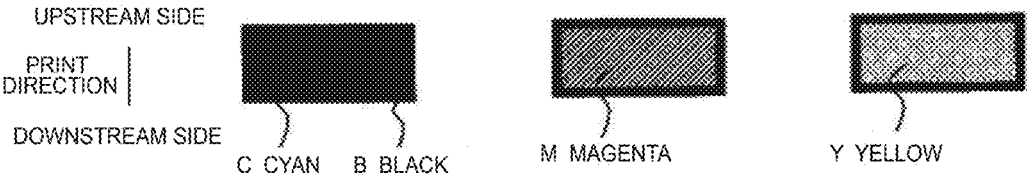
FIGS. 7A and 7B are explanation diagrams illustrating a configuration example of a misregistration presence check pattern printed by the image formation device according to the embodiment.
Figure 7B:
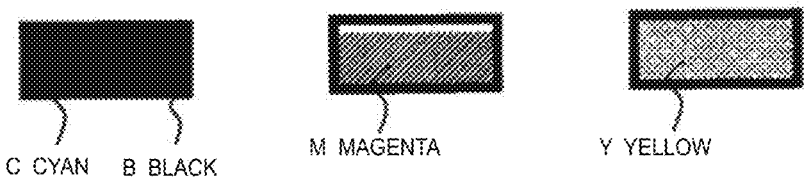

Next, using FIGS. 7A and 7B, a description is given of a configuration example of the misregistration presence check pattern printed in Step S3 described above.

The misregistration presence check pattern in each of FIGS. 7A and 7B is an image that enables the user to visually check whether there is misregistration of an image of a color other than black (any of cyan, magenta, and yellow) with respect to an image of black as a reference image. In the misregistration presence check pattern illustrated in each of FIGS. 7A and 7B, there are print images (hereinafter referred to as "block images for checking") each made by filling an area inside a rectangular border line (a rectangular border line drawn by a line having a width of about 2-3 dots, for example) of black as the reference color with a color other than black (any of cyan, magenta, and yellow). In the following description, in the misregistration presence check pattern, a downstream side in a print direction is referred to as a plus direction (+ direction) and an upstream side in the print direction is referred to as a minus direction (− direction).

In the misregistration presence check pattern illustrated in each of FIGS. 7A and 7B, block images for checking, prepared for the respective colors of cyan, magenta, and yellow (3 block images for checking in total), are printed while being arranged in the main-scanning direction (width direction). The user can check whether there is any misregistration of each of the colors other than black by visually checking whether or not the position of the image (image of the color) inside the black border line is misaligned.

For example, it can be recognized from FIG. 7A that no misalignment of an image inside a border line occurs in any of the block images for checking of the toner colors (i.e., the image of each toner color is perfectly fitted in the black border line), and thus there is no misregistration in any of the toner colors.

Meanwhile, for example, it can be recognized from FIG. 7B that the image of magenta is not perfectly fitted in the black border line but is misaligned in the downstream direction (+ direction) in the block image for checking of magenta (central image). Specifically, it can be recognized from FIG. 7B that a part of recording medium P is exposed inside the black border line in the block image for checking of magenta, and thus there is misregistration in the toner color of magenta. In other words, if there is a block image for checking where a part of recording medium P is exposed inside the black border line, it means that there is misregistration in the image.

Next, a description is given of a configuration example of the misregistration amount check pattern printed in Step S21 described above, and the contents of the manual misregistration correction processing.

Figure 8:
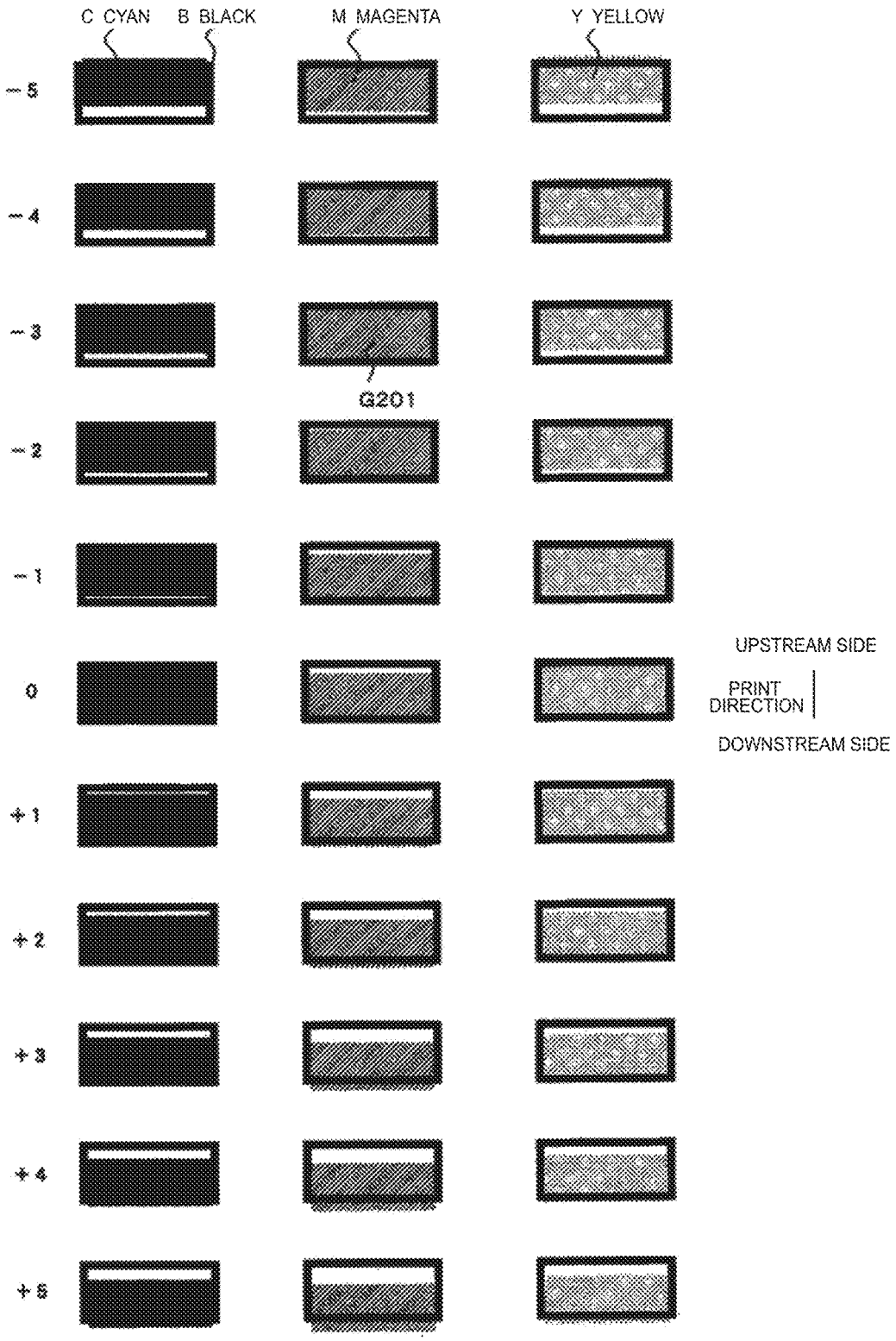
FIG. 8 is an explanation diagram illustrating a configuration example of a misregistration amount check pattern printed by the image formation device according to the embodiment.

FIG. 8 is an explanation diagram illustrating the configuration example of the misregistration amount check pattern.

The misregistration amount check pattern in FIG. 8 is an image that enables the user to visually check the amount of misregistration of an image of a color other than black (any of cyan, magenta, and yellow) with respect to an image of black as a reference image.

The misregistration amount check pattern is formed by using the same block images for checking as ones in the misregistration check pattern described above. In the following description, in the misregistration amount check pattern, a downstream side in the print direction is referred to as a plus direction (+ direction) and an upstream side in the print direction is referred to as a minus direction (− direction).

The misregistration amount check pattern in FIG. 8 is constituted by block images for checking made by displacing images of each of the colors other than black (cyan, magenta, and yellow) from the corresponding black images by values in a range from −5 dots to +5 dots sequentially. More specifically, the misregistration amount check pattern in FIG. 8 is constituted by block images for checking (11 images for each toner color, and 33 images in total) made by displacing images of each of cyan, magenta, and yellow from the corresponding black images by values in a range from −5 dots to +5 dots sequentially.

FIG. 8 illustrates a state where a toner color of magenta is misaligned in the plus direction (downstream) by 3 dots with respect to black as a reference color, and there is no misregistration of the other colors, i.e., cyan and yellow. It can be visually recognized from FIG. 8 that, among the block images for the checking of magenta, an image of magenta is fitted in a border line of black as the reference color without any gap (the images of magenta and black perfectly overlap each other) and no recording medium P is exposed only in block image for checking G201 (the third block image for checking from the top in the center column) in which the magenta image is displaced by −3 dots. Hence, by visually observing the misregistration amount check pattern in FIG. 8, the user can recognize that only the toner color of magenta is misaligned by −3 dots. In this way, the user can check the amount of misregistration of each toner color currently occurring by visually observing recording medium P on which the misregistration amount check pattern is printed, and input the misregistration amount thus recognized into image formation device 1 (by using manipulation panel unit 14, for example).

For example, by visually observing the misregistration amount check pattern in FIG. 8, the user finds that what he/she needs to do is to input the misregistration correction amount of −3 dots for the toner color of magenta, and thus inputs "magenta" in above Step S22, and "−3 dots" in above Step S23 as the misregistration correction amount. In this way, main controller 10 can let the user manually input the toner color to be the misregistration correction target and the misregistration correction amount.

(A-3) Effects of Embodiment

The following effects can be obtained according to this embodiment.

Image formation device 1 of this embodiment in the roll-to-roll print mode performs the manual misregistration correction processing by printing the misregistration check pattern (the misregistration presence check pattern in this embodiment) on recording medium P after the printing of the print job is over. Specifically, image formation device 1 of this embodiment in the roll-to-roll print mode prints the misregistration check pattern (the misregistration presence check pattern in this embodiment) on recording medium P in a part which is transported without printing during a period until the temperature of fixing roller 41 is determined to be decreased enough (i.e., a wasted part of recording medium P) after the printing of the print job is over. Thereby, in this embodiment, the user can easily visually check whether or not misregistration occurs. Thus, even if misregistration is recognized by the user, image formation device 1 can correct misregistration with recording medium P mounted thereon, so that a favorable print quality can be achieved all over the long recording medium P (large-diameter roll sheet). In other words, according to this embodiment, image formation device 1 can carry on a one-pass operation even if the user performs an operation based on the manual misregistration correction processing described above because recording medium P does not need cutting for this processing. This saves the trouble and time of mounting the recording medium for later processes and thereby improves working efficiency.

Additionally, image formation device 1 of this embodiment prints the misregistration check pattern (the misregistration presence check pattern in this embodiment) at the wasted part of recording medium P which is generated immediately after the printing in the roll-to-roll print mode is over. In other words, the misregistration check pattern is formed at the wasted part of recording medium. P which is inevitably generated during the cool-down of image formation device 1, which enables an efficient use of recording medium P.

Further, according to this embodiment, the automatic misregistration correction processing is performed after the print job is executed in the roll-to-cut print mode, which enables further efficient misregistration correction processing.

(B) Other Embodiments

The invention is not limited to the embodiment described above but includes modified embodiments as exemplified below.

B-1

In the above embodiment, the parameters, such as the correction timing, the misregistration correction range, and the threshold temperature for fixing unit 16 to be applied to image formation device 1, may be adjustable. Each parameter value is preferably decided through verification by experiment so as to be fitted to the configuration of image formation device 1.

B-2

According to the description of the embodiment above, image formation device 1 supports both the automatic misregistration correction processing and the manual misregistration correction processing. Alternatively, image formation device 1 may support only the manual misregistration correction processing (that is, support only the roll-to-roll print mode). In this case, cutter unit 4 does not necessarily have to be provided in image formation device 1.

B-3

According to the above embodiment, in the roll-to-roll print mode, the misregistration presence check pattern is printed as the misregistration check pattern in above Step S3 after the printing operation. However, the misregistration amount check pattern may be printed at this time instead. In this case, the processing in Step S21 above (processing of the printing of the misregistration amount check pattern according to the manipulation by the user) may be omitted.

Further, according to the above embodiment, the misregistration check pattern is printed during the cool-down of the image formation device after the printing operation (after the image formation processing by the image formation unit). However, the misregistration check pattern may be printed during a warm-up of the image formation device or the image formation unit, for example.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image formation device comprising:

an image formation unit configured to perform image formation processing of forming a print image based on a print job on a long medium using developers of different colors;

a misregistration check image formation unit configured to control the image formation unit to cause the image formation unit to form a misregistration check pattern on the medium;

a misregistration correction amount input unit configured to receive input of an amount of misregistration correction to be applied to the image formation unit; and a controller configured to correct misregistration in the image formation processing by the image formation unit, based on the amount of misregistration correction received by the misregistration correction amount input unit, wherein the image formation unit further comprises a transport belt configured to transport the medium in the image formation device, and a sensor configured to detect an image formed on the transport belt, the image formation unit is capable of forming an image on the medium in any one of a first image formation mode where the medium is cut after the image formation processing and a second image formation mode where the medium is not cut after the image formation processing, the image formation device further comprises an automatic misregistration correction unit configured to, after the medium is cut after the image formation unit executes the image formation processing in the first image formation mode, control the image formation unit to cause the image formation unit to form an automatic misregistration correction pattern on the transport belt, control the sensor to make the sensor detect the automatic misregistration correction pattern on the transport belt, and obtain an amount of misregistration correction to be applied to the image formation unit based on a result of the detection by the sensor, the misregistration check image formation unit is configured, after the image formation unit executes the image formation processing in the second image formation mode, to control the image formation unit to cause the image formation unit to form the misregistration check pattern on the medium, and the controller is configured to correct the misregistration in the image formation processing by the image formation unit, based on the amount of misregistration correction obtained by the automatic misregistration correction unit or the amount of misregistration correction received by the misregistration correction amount input unit.

2. The image formation device according to claim 1, wherein the misregistration check image formation unit controls the image formation unit to cause the image formation unit to form the misregistration check pattern after the image formation unit finishes the image formation processing.

3. The image formation device according to claim 1, wherein the misregistration check image formation unit controls the image formation unit to cause the image formation unit to form the misregistration check pattern during warm-up of the image formation device.

4. The image formation device according to claim 1, wherein the misregistration check image formation unit controls the image formation unit to cause the image formation unit to form the misregistration check pattern at a wasted part of the medium.

5. The image formation device according to claim 4, wherein the wasted part of the medium is a part of the medium other than a part thereof passing through the image formation unit during the image formation processing by the image formation unit.

6. The image formation device according to claim 4, wherein the misregistration check image formation unit controls the image formation unit to cause the image formation unit to form the misregistration check pattern at a part of the medium passing through the image formation unit during a cool-down of the image formation device.

7. The image formation device according to claim 4, wherein the misregistration check image formation unit controls the image formation unit to cause the image formation unit to form the misregistration check pattern at a part of the medium passing through the image formation unit during a warm-up of the image formation device.

8. The image formation device according to claim 1, further comprising:

a first roller configured to feed the medium to a medium transport route; and a second roller configured to roll up the medium fed to the medium transport route by the first roller, wherein the image formation unit is disposed along the medium transport route between the first roller and the second roller.

9. The image formation device according to claim 1, further comprising a correction timing determination unit configured to determine a correction timing for the image formation unit to perform misregistration correction processing, wherein if the correction timing determination unit determines that the correction timing arrives, the misregistration check image formation unit controls the image formation unit to cause the image formation unit to form the misregistration check pattern on the medium after the image formation unit finishes the image formation processing based on the print job.

10. The image formation device according to claim 9, wherein the correction timing determination unit determines that the correction timing arrives every time an amount of operation of the image formation unit reaches a predefined amount.

11. The image formation device according to claim 1, wherein after the image formation unit finishes the image formation processing, the misregistration check image formation unit controls the image formation unit to form, on the medium, a misregistration presence check pattern allowing a user to visually check if there is misregistration.

12. The image formation device according to claim 1, wherein in response to a manipulation by a user, the misregistration check image formation unit controls the image formation unit to cause the image formation unit to form, on the medium, a misregistration amount check pattern allowing the user to visually check an amount of misregistration.

* * * * *